United States Patent [19]

Aubert

[11] 4,085,531

[45] Apr. 25, 1978

[54] GRAVE DIGGING MACHINE

[76] Inventor: Georges Aubert, La Cerisae, 71570 La Chapelle, Pontanevaux, France

[21] Appl. No.: 777,107

[22] Filed: Mar. 14, 1977

Related U.S. Application Data

[63] Continuation-in-part of Ser. No. 631,343, Nov. 12, 1975, abandoned, which is a continuation of Ser. No. 536,693, Dec. 26, 1974, abandoned, which is a continuation of Ser. No. 422,905, Dec. 7, 1973, abandoned.

[30] Foreign Application Priority Data

Sep. 14, 1973 France ..... 73 34049

[51] Int. Cl.[2] ..... E02F 5/20

[52] U.S. Cl. ..... 37/190; 37/DIG. 6

[58] Field of Search ..... 37/DIG. 6, 191; 182/119

[56] References Cited

U.S. PATENT DOCUMENTS

| | | | |
|---|---|---|---|
| 1,224,323 | 5/1917 | Rice | 37/DIG. 6 |
| 1,341,138 | 5/1920 | Kincade | 37/DIG. 6 |
| 2,624,129 | 1/1953 | Steece | 37/DIG. 6 |
| 2,653,795 | 9/1953 | Reeves | 37/DIG. 6 |
| 2,884,721 | 5/1959 | Pool | 37/DIG. 6 |
| 3,107,444 | 10/1963 | Crum et al. | 37/DIG. 6 |
| 3,550,294 | 12/1970 | Fewell | 37/DIG. 6 |

FOREIGN PATENT DOCUMENTS

| | | | |
|---|---|---|---|
| 1,453,391 | 8/1966 | France | 182/119 |

*Primary Examiner*—Clifford D. Crowder
*Attorney, Agent, or Firm*—William Anthony Drucker

[57] ABSTRACT

An apparatus for the mechanical digging of graves has a frame which can be adjusted in width to enable it to pass between headstones in a cemetry. A carrier is vertically adjustable in the frame, and a digging assembly is traversable longitudinally within the frame. A bucket conveyor and motorized digging attachment are carried on a rigid structure which is vertically adjustable with respect to a sub-frame of the carrier.

2 Claims, 2 Drawing Figures

GRAVE DIGGING MACHINE

This is a continuation-in-part of application Ser. No. 631,343 filed Nov. 12, 1975 (now abandoned), which was itself a continuation of application Ser. No. 536,693 filed Dec. 26, 1974 (now abandoned), which was itself a continuation of application Ser. No. 422,905 filed Dec. 7, 1973 (now abandoned).

This invention relates to an apparatus for the mechanical digging of graves in cemeteries.

Apparatus for this purpose is already known in the art, but the apparatus of the prior art generally has been manufactured as a single entity which is relatively bulky in dimensions, and heavy in weight, and thus very awkward to move about, especially in confined spaces. Further, the known apparatuses have not permitted the complete extraction of the soil from the grave, nor provided a completely satisfactory neat surface to the walls and floor of the grave.

The object of the present invention is to provide an apparatus, for the mechanical digging of graves, which has a relatively light-weight frame, which can be dismantled and which allows digging to be carried out in confined and relatively inaccessible positions. Further, the digging assembly can, if required, be separated from the frame, especially to facilitate transporting of the apparatus to the position of use.

An embodiment of grave digging apparatus in accordance with the invention is hereinafter particularly described with reference to the accompanying drawings, wherein.

Figure 1:
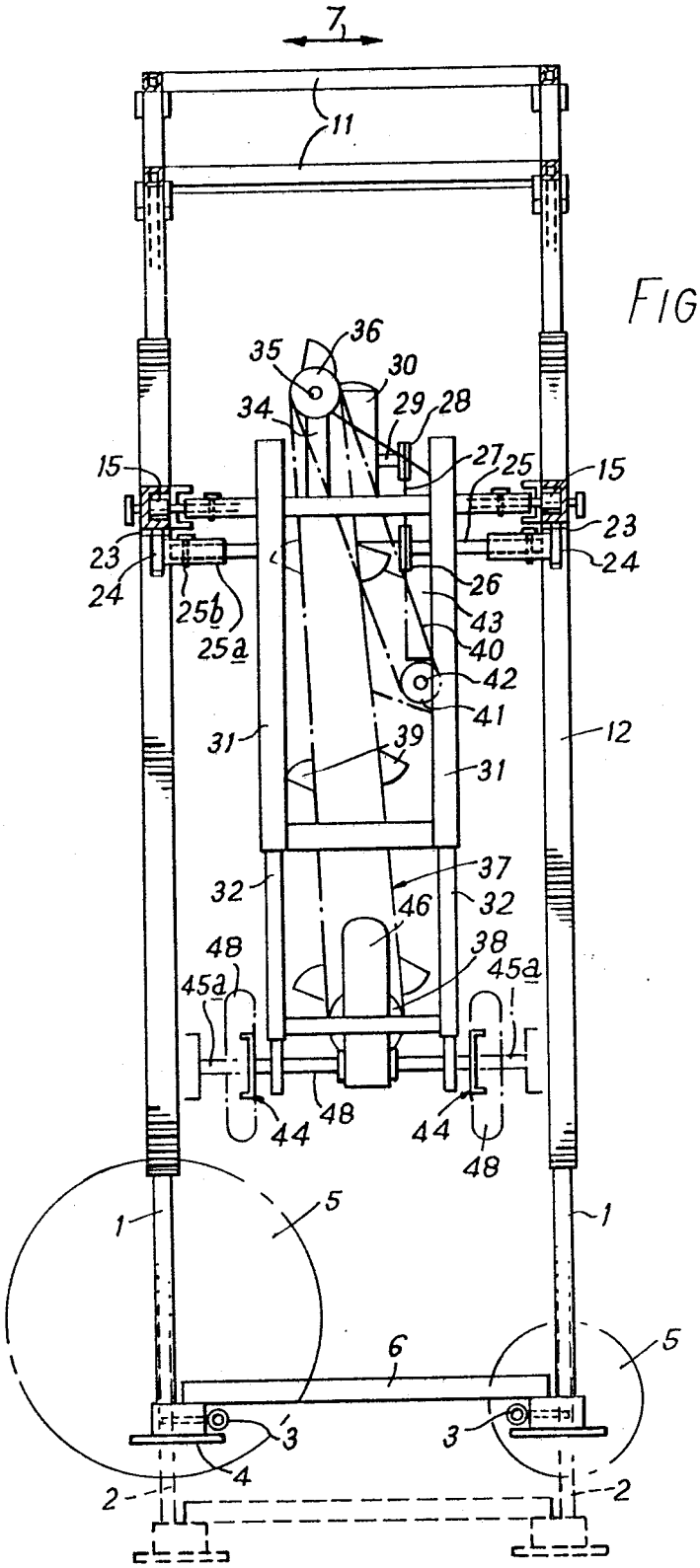
FIG. 1 is an end elevation of the apparatus.
Figure 2:
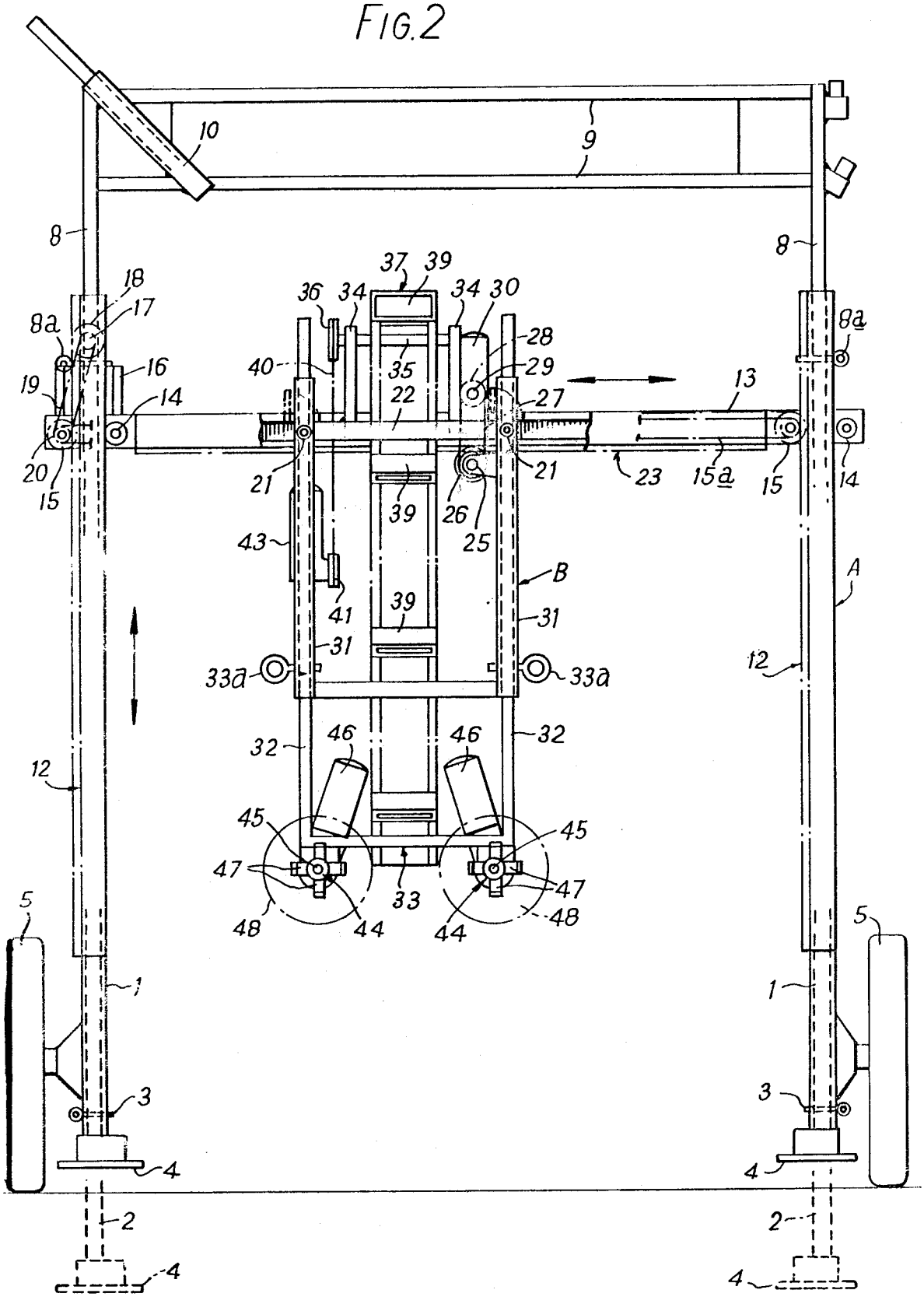
FIG. 2 is a side elevation thereof.

As shown in the drawings, the apparatus comprises two main parts, viz. a supporting frame A, and a digging assembly B.

The frame A is substantially parallelepipedal and comprises four vertical corner posts 1 each of which has at its lower end a respective leg 2 which can slide telescopically inside the corner post and which can be secured in a required position of vertical adjustment by a transverse locking pin 3 which can be inserted through the post and the leg. Each leg 2 has its lower end a base plate 4 to seat onto the ground, during use of the apparatus. Each corner post 1 also has journalled thereon a respective large, or small, road wheel 5 which, when the legs 2 have been secured in their upper position, can be used for wheeling the frame on the ground into and out of position over a grave site. Across the ends of the frame, (see end elevation, FIG 1) at the lower part, there are provided cross-bars 6, but there are no cross-bars at the sides of the frame, at its lower part. The cross-bars 6 can be disconnected and replaced by others of a required length.

In the upper end of each corner part 1 there is slidably engaged an upright element 8 whose position can be adjusted vertically, by telescoping, and then locked by a transverse pin **8*a*. The uprights 8 are connected integrally by side members 9, so that the length of the side of the apparatus cannot be changed. However, the uprights 8 have secured thereon sockets 10 which receive the inclined downturned ends of inverted U-shaped cross-members 11, and the overall width of the frame can accordingly be changed, in the directions indicated by arrow 7 in FIG. 1, by replacing and inserting cross-members 11 of the required length. The cross-bars 6 would also be changed, at the same time, to correspond to the length of the cross-members 11**.

On each corner post 1 there is mounted a vertical rack 12, and a horizontal carrier 13 receives each rack and corner post between a respective guide roller 14 and rack pinion 15. All four of the rack pinions 15 are coupled, for simultaneous rotation, by drive chains **15*a*, and a electric motor 16 mounted at one end of the carrier 13 has a speed-reduced output shaft 17 on which is keyed a sprocket 18 driving a chain 19 driving a sprocket 20 keyed on the same spindle as one of the pinions 15. Accordingly, the motor 16 can be used to drive the carrier 13** symmetrically up and down within the frame A.

The longitudinal horizontal side members of the carrier 13 are out-turned C-section girders which form rails which carry rollers 21 journalled on horizontal side elements 22 of a sub-frame of the assembly B, whereby the assembly B can roll freely in both directions longitudinally towards the ends of the main frame A. On the side members of the carrier 13 there are mounted downwardly facing racks 23 which are engaged by rack pinions 24 keyed on a shaft 25 supported on brackets. To allow for alteration of the width of the frame 1, as described, the axial spacing of the pairs of rack pinions 24 can be adjusted, by a telescopic assembly consisting of shafts 25 slidable in sleeves **25*a* and securable at a desired axial length by means of removable cross-pins 25*b*, and an exactly similar arrangement is provided to allow axial adjustment of the drive shaft for the pinions 15**.

The shaft 25 has keyed on it a sprocket 26 which is engaged with a chain 27 engaged about another sprocket 28 mounted on a slow-speed output shaft 29 of an electric motor 30 with speed reduction gear. Accordingly, by use of the electric motor 30, the assembly B can be driven from end to end of the carrier 13, to adjust the position of digging of the ground.

The sub-frame of the assembly B has four vertical corner tubes 31 in which are vertically telescopically slidable four respective arms 32 of a rigid structure 33. The position of vertical adjustment of the structure 33 can be altered and secured by means of cross-pins **33*a* engaged through the respective tubes 31 and the arms 32** sliding in them.

On the upper part of the sub-frame of assembly B there are mounted supports 34 for a rotatable shaft 35 which has keyed rollers carrying a conveyor belt 37 engaged also about a lower pulley 38. The belt 37 has digging buckets 39. On the shaft 35 there is also keyed a sprocket 36 meshed with a chain 40 engaged about a drive sprocket 41 keyed on the slow-speed output shaft 42 of a reduced-speed electric drive motor 43 serving to drive the digging conveyor belt.

At the lower end of the assembly B, at each corner, there is mounted a respective rotary digger element 44. The pair of elements 44 at each end of the assembly B are mounted on a respective common shaft 45 which is driven by an electric motor 46 with speed reduction. During use of the machine for digging a grave, the rotary elements utilise their arms 47 for digging the ground, but when the apparatus is dismantled so that the assembly B is separate from the frame A, the elements 44 may be replaced by tyred wheels 48 (indicated in chain-dotted line in FIG. 1) to enable the assembly B to be moved along the ground under its own power.

The shafts 45 can be fitted with extensions **45*a* to vary the width of the hole to be dug by the arms 47**.

I claim:

1. A grave digging apparatus comprising, in combination:

(i) a supporting frame including:

(a) two side frame structures spaced transversely of the frame (b) two cross-bars disposed one at each end of the frame and connected releasably to the lower part of each side frame structure (c) two upper cross-members engaged releasably with the side frame structures at a respective end of the frame, and (d) vertical rack means on said side frame structures;

(ii) a carrier disposed longitudinally in the frame between the two side frame structures, said carrier including pinion means meshing with said vertical rack means, and drive means connected to the pinion means to drive the carrier up and down within the frame; said carrier further including horizontal rack means thereon;

(iii) a digging assembly supported on and movable along said carrier in the longitudinal direction of the frame, said digging assembly having pinion means meshed with said horizontal rack means and drive means for rotating said pinion means for driving the digging assembly along the carrier, said digging assembly including a sub-frame, a rigid structure telescopically vertically slidable with respect to said sub-frame, a belt and bucket excavator carried on said sub-frame and on said rigid structure, and means for driving said belt and bucket excavator.

2. A grave digging apparatus, as claimed in claim 1, wherein said digging assembly further comprises a plurality of rotary digger elements mounted at a lower end of said rigid structure remote from said carrier, and drive means on said rigid structure coupled to said digger elements for rotating them.

* * * * *